United States Patent [19]

Nagy

[11] Patent Number: 4,679,823

[45] Date of Patent: Jul. 14, 1987

[54] SHELF FILING SYSTEM WITH IDENTIFICATION HANDLE FOR FILE POCKETS

[76] Inventor: Francis J. Nagy, 33325 Rockford Dr., Solon, Ohio 44139

[21] Appl. No.: 662,372

[22] Filed: Oct. 18, 1984

[51] Int. Cl.[4] ..... B42F 21/00; B42D 17/00; B42D 9/00; B15D 25/22

[52] U.S. Cl. ..... 281/15 A; 281/42; 281/45; 283/81; 229/52 AL

[58] Field of Search ..... 281/15 A, 45, 48, 42; 283/79, 81; 140/74; 235/462; 493/375, 918, 961, 861; 229/52 A, 52 AL; 206/425, 813; 40/2 R

[56] References Cited

U.S. PATENT DOCUMENTS

| | | | |
|---|---|---|---|
| 1,197,314 | 9/1916 | Wells | 281/45 |
| 1,463,827 | 8/1923 | McNeill et al. | 281/45 |
| 3,031,359 | 4/1962 | Blank et al. | 229/52 AL |
| 3,537,194 | 11/1970 | Engle | 493/861 |
| 3,697,100 | 10/1972 | Hawkins | 281/42 |
| 3,814,527 | 6/1974 | Lawes | 281/45 |
| 3,900,642 | 8/1975 | Michel | 281/45 |
| 4,296,861 | 10/1981 | Barrash | 229/52 AL |
| 4,355,824 | 10/1982 | Weber et al. | 283/81 |
| 4,359,633 | 11/1982 | Bianco | 235/462 |
| 4,486,032 | 12/1984 | Leahy | 281/48 |

*Primary Examiner*—Paul A. Bell
*Assistant Examiner*—Paul M. Heyrana, Sr.
*Attorney, Agent, or Firm*—Renner, Otto, Boisselle & Lyon

[57] ABSTRACT

A shelf filing identification handle and method for identifying and facilitating withdrawal of file pockets or the like from a horizontal row thereof are characterized by a flexible loop forming strap having a central portion upon which identifying indicia may be applied, and adhesive means which may be rendered operative only at respective ends of the strap for affixing the strap ends to respective walls of the file pocket adjacent a side edge thereof with the central portion forming an open loop projecting outwardly beyond such side edge of the file pocket. The identifying indicia applied to the outwardly projecting central portion can be easily viewed for file identification without having to remove the file pocket. When removal is desired, the open loop may be easily grasped and pulled to withdraw the file pocket from the horizontal row without damage to the file pocket.

7 Claims, 6 Drawing Figures

SHELF FILING SYSTEM WITH IDENTIFICATION HANDLE FOR FILE POCKETS

DISCLOSURE

The invention herein disclosed relates generally to an accessory for a file pocket or the like in a shelf filing system and, more particularly, to a shelf filing identification handle and method for identifying and facilitating withdrawal of file pockets or the like from horizontal rows thereof.

BACKGROUND

File pockets are commonly used to file bulky correspondence, reports, brochures, samples, etc., not easily contained in regular file folders. A standard-type file pocket has front and back walls joined at their bottom and side edges by an expandable gusset. The back wall usually extends higher than the front wall to provide a tab for file identification.

File pockets are generally neat in appearance and suitable for shelf filing as well as closed cabinet filing. Shelf filing is a method of storing file pockets or the like on shelves in horizontal rows rather than in pull-out file drawers. One problem with shelf filing is that the file pocket oftentimes must be removed from the horizontal row to permit identification. In an effort to avoid this problem, shelf guides with side tabs have been used. Also, tabs or tab guides have been affixed at the side edges of the file pockets or file folders.

Of course, file pockets may be removed from the horizontal row from time to time when needed. It has been observed that removal of a file pocket from the horizontal row often is accomplished by grasping and pulling the gusset at the exposed side of the file pocket. Repeated withdrawal of a file pocket in this manner may cause permanent outward bowing and sometimes tearing of the gusset or other damage to the file pocket especially if the file pockets are together tightly stacked in the horizontal row.

SUMMARY OF THE INVENTION

The present invention overcomes the aforenoted problems associated with existing shelf filing systems for file pockets or the like by the provision of a shelf filing identification handle and method for identifying and facilitating withdrawal of the file pockets from a horizontal row thereof. The shelf filing identification handle is inexpensive and easy to use in accordance with the invention.

Briefly, a shelf filing identification handle according to the invention comprises a flexible loop forming strap having a central portion upon which identifying indicia may be applied, and adhesive means which may be rendered operative only at respective ends of the strap for affixing the strap ends to respective walls of a file pocket or the like adjacent a side edge thereof with the central portion forming an open loop projecting outwardly beyond such side edge of the file pocket. The open loop can be easily grasped and pulled for convenient removal of the file pocket from a horizontal row of file pockets without damaging the file pocket. Also, the identifying indicia applied to the central portion of the strap can be easily viewed for file identification without having to remove the file pocket from the horizontal row.

According to another aspect of the invention, an improved file pocket or the like for shelf filing systems comprises front and back walls joined together at least along their bottom edges, and a strap having a central portion upon which identifying indicia may be applied and respective ends joined to the front and back walls of the file pocket adjacent a side edge thereof with the central portion forming an open loop projecting outwardly beyond such side edge of the file pocket.

According to still another aspect of the invention, a method of identifying and facilitating withdrawal of file pockets or the like from a horizontal row thereof on a shelf comprises the steps of applying identifying indicia to a central portion of a flexible loop forming strap, and securing the end of the strap to respective front and back walls of a file pocket adjacent a side edge thereof with the central portion forming an open loop projecting outwardly beyond such side edge of the file pocket so as to permit identification without removal of the file pocket from the horizontal row and, when desired, to provide a convenient handle for withdrawal of the file pocket from the horizontal row.

To the accomplishment of the foregoing and related ends, the invention, then, comprises the features hereinafter fully described and particularly pointed out in the claims, the following description and the annexed drawing setting forth in detail certain illustrative embodiments of the invention, these being indicative, however, of but a few of the various ways in which the principles of the invention may be employed.

BRIEF DESCRIPTION OF THE DRAWING

In the annexed drawing:

FIG. 2 is a perspective view showing the front side of a shelf filing identification handle prior to attachment to a file pocket or the like;

DETAILED DESCRIPTION

Figure 1:
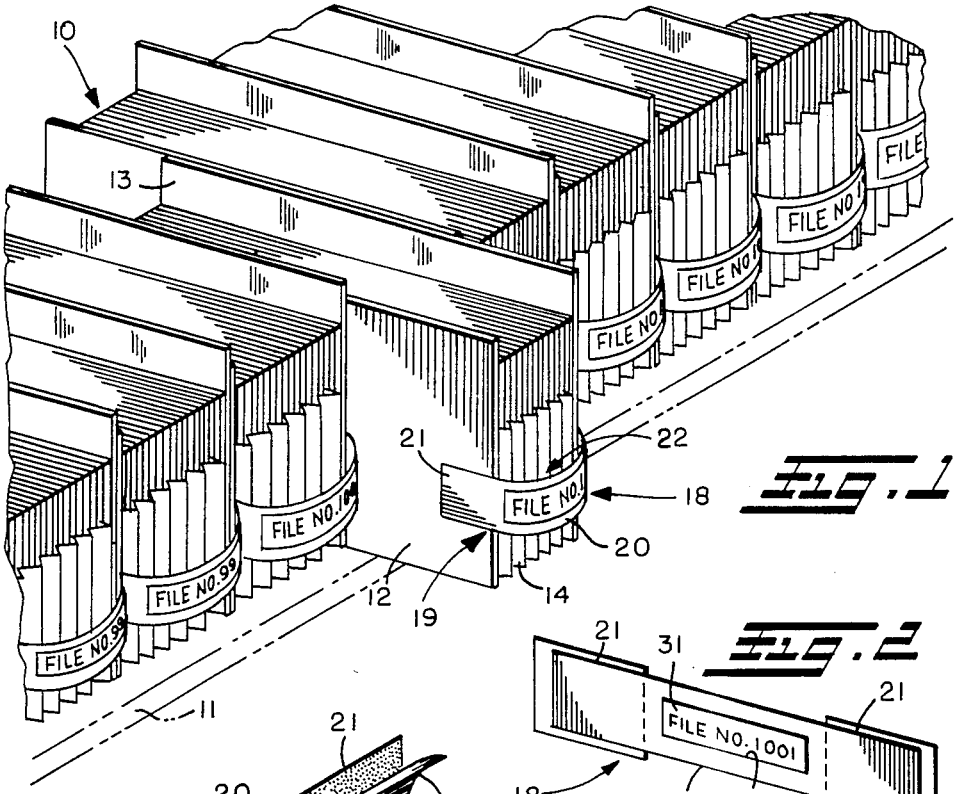
FIG. 1 is a partial perspective view of a shelf filing system utilizing file pockets having shelf filing identification handles according to the present invention.

Referring now in detail to the drawing, FIG. 1 shows a shelf filing system wherein a plurality of file pockets, indicated generally at 10, are stored on a shelf 11 in a horizontal row. A representative file pocket is partially withdrawn from the horizontal row and can be seen to include front and back walls 12 and 13. The walls 12 and 13 are joined at their bottom and side edges by an expandable gusset 14 as is conventional. The top of the file pocket is open for insertion of correspondence, brochures, catalogs, samples, etc. as shown.

At the leading edge of the file pocket 10 there is attached a shelf filing identification handle according to the present invention. The handle, indicated generally at 18, includes a loop forming strap 19 having a central portion 20 upon which identifying indicia may be applied as shown. The strap 19 also has opposite end portions 21 respectively joined flat against the outer surfaces of the front and back walls 12 and 13 of the file pocket adjacent the leading side edge thereof with the central portion 20 forming an open loop projecting outwardly beyond such side edge of the file pocket as indicated at 22.

As will be appreciated, the handle 18 permits identification of the file pocket 10 without having to remove the file pocket from the horizontal row. When removal is desired, the open loop 22 may be easily grasped and pulled to withdraw the file pocket from the horizontal row with the pulling force being applied directly and substantially equally to the front and back walls 12 and 13 in a direction substantially parallel to the planar extents of such walls so as not to cause damage to the file pocket. Handles 18 may be provided in different lengths corresponding to different thicknesses or expanded thicknesses of file pockets or similar filing supplies. For any given file thickness, the central portion 20 of the handle 18 should be of sufficient length to form a loop 22 permitting insertion of one's fingers between the central portion 20 and the adjacent side of the file pocket for grasping and pulling of the handle (i.e., between the central portion 20 and the side gusset 14 in the illustrated embodiment). By way of example, the central portion may have a length of 5.5 inches for a file pocket expandable to 5 inches. Also, the strap may have a top edge to bottom edge dimension of 2 inches and each end portion may be 2 inches in length for a strap having a total length of 9.5 inches.

Figure 2:
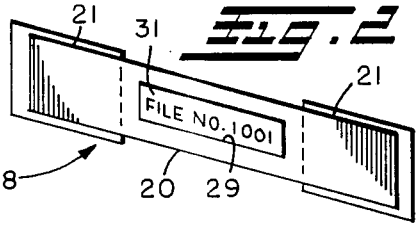
Figure 3:
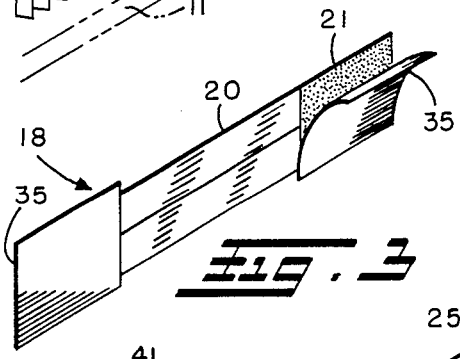
FIG. 3 is a perspective view showing the back side of the shelf filing identification handle of FIG. 2.
Figure 4:
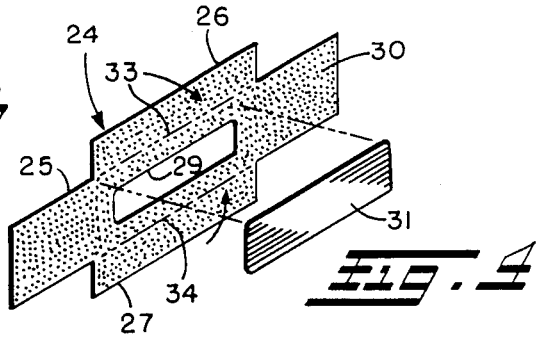
FIG. 4 is an exploded perspective view illustrating the manner in which the shelf filing identification handle of FIG. 2 may be constructed.

In FIGS. 2 and 3, the shelf filing identification handle 18 is shown as it may be supplied before installation on a file pocket or the like, and in FIG. 4 there is illustrated one method of manufacture. As seen in FIG. 4, a blank 24 of sheet material may be die cut to the illustrated shape having a major portion 25 corresponding to the finished dimensions of the handle strap 19, top and bottom tab portions 26 and 27 corresponding in length to the central portion 20 of the handle strap, and a window 29 centrally located between the ends of the major portion 25 projecting beyond the tab portions 26 and 27. The back side of the blank 24 (the side seen in FIG. 4) has applied thereon a pressure sensitive adhesive indicated by the stippling 30, and an insert 31 is adhered to the blank 24 such that the insert spans the window 29. The insert 31 may be of any material suitable for application of identifying indicia thereon as by writing instruments commonly found in the office environment such as pencils, ball point pens and felt tip pens. For example, the insert 31 may be a strip of paper sized slightly larger than the window 29 for adherence at its margin to the blank 24. On the other hand, the blank 24 should be of a material having high tensile strength and high resistance to tearing while being sufficiently flexible to permit formation of the loop 22 (FIG. 1) at the central portion 20. Such material may be plastic, reinforced cloth-lined redrope, leather or leather-like material, or TYVEK paper of spun bonded olefin, by way of example.

After the insert 31 is set in place, the top or bottom tab portion 26, 27 is folded thereover and then the other along their respective fold lines 33, 34. As seen in FIG. 3, the folded tab portions 26 and 27 butt or overlap completely to cover the adhesive 30 on the back side of the central portion 20. The adhesive on each end portion 21 remains exposed but, as is desired, is covered by a strip of release paper 35 until such time that the handle 18 is to be installed on a file pocket or the like. At that time, the release paper 35 may be removed to render the adhesive operative only at the end portions 21 for attachment to respective walls 12 and 13 of the file pocket 10 in the manner discussed above and shown in FIG. 1. There should be no adhesive operative on the back side of the central portion 20 or otherwise the loop 22 might close on itself or become attached to the gusset 14, both being undesirable.

Figure 5:
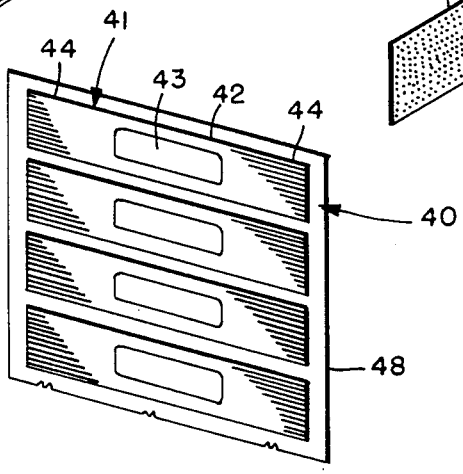
FIG. 5 is a partial perspective view of another form of shelf filing identification handle, there being shown a plurality of such handles carried on a sheet of release paper.
Figure 6:
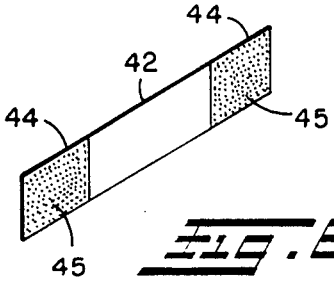
FIG. 6 is a perspective view of the back side of the shelf filing identification handle of FIG. 5.

Referring now to FIGS. 5 and 6, shelf filing identification handles of another form embodying principles of the invention are commonly indicated generally by reference numeral 40. Each handle 40 includes a strap 41 of flexible material having high tensile strength and high resistance to tearing such as TYVEK paper. The strap has a central portion 42 upon which may be applied an opaque ink 43 as by a printing process. The opaque ink or similar material such as liquid paper material, which can be seen in FIG. 5 to cover a rectangular area, permits printing or writing of identifying indicia on the central portion 42 which might not otherwise be satisfactorily accomplished by reason of the surface characteristics of the material from which the strap 41 is made.

The end portions 44 of the strap 41 have adhesive material indicated by the stippling 45 applied to the back sides thereof as seen in FIG. 6. Preferably the adhesive material 45 is of pressure sensitive type although other suitable adhesive materials such as a moisture activated gum adhesive may be used. Release paper may be used to cover the pressure sensitive adhesive until such time as the handle is to be installed on a file pocket. As seen in FIG. 5, a plurality of handles may be carried on a sheet of release paper 48. When needed, the handles may be selectively removed from the carrier sheet 48 and installed on a file pocket or the like in the manner discussed above in connection with the other illustrated form of handle 18.

Although the invention has been shown and described with respect to certain preferred embodiments, it is obvious that equivalent alterations and modifications will occur to others skilled in the art upon the reading and understanding of this specification. The present invention includes all such equivalent alteration and modifications, and is limited only by the scope of the following claims.

I claim:

1. In combination with a file pocket or other file holder for shelf filing systems adapted to be supported at a bottom edge thereof on a shelf and including front and back walls joined together at least along their bottom edges for retaining therebetween file materials, a strap having a central portion upon which identifying indicia may be applied, said strap further having respective ends joined to said front and back walls adjacent a side edge thereof with the central portion forming an open loop projecting outwardly beyond such side edge of the file pocket.

2. A combination as set forth in claim 1, wherein said strap is made of a flexible material having high tensile strength and high resistance to tearing.

3. A combination as set forth in claim 2, wherein said central portion has a length greater than the maximum side width of said file pocket.

4. A combination as set forth in claim 2, wherein said strap has opposite end portions secured flat to respective front and back walls of said file pocket.

5. A combination as set forth in claim 4, wherein said end portions are secured flat to said front and back walls by adhesive.

6. A combination as set forth in claim 5, wherein said adhesive is of the pressure sensitive type.

7. A combination as set forth in claim 3, wherein said central portion includes a paper-like material exposed to the front side of said strap.

* * * * *